US010089969B1

(12) United States Patent
Chen

(10) Patent No.: US 10,089,969 B1
(45) Date of Patent: Oct. 2, 2018

(54) UPRIGHT FLOOR STAND FOR GUITAR

(71) Applicant: Aroma Music Co., Ltd., Shenzhen (CN)

(72) Inventor: Haihua Chen, Shenzhen (CN)

(73) Assignee: AROMA MUSIC CO., LTD., Shenzhen (CN)

( * ) Notice: Subject to any disclaimer, the term of this patent is extended or adjusted under 35 U.S.C. 154(b) by 0 days.

(21) Appl. No.: 15/802,710

(22) Filed: Nov. 3, 2017

(30) Foreign Application Priority Data

Sep. 21, 2017 (CN) ..... 2017 1 216879

(51) Int. Cl.
*G10G 5/00* (2006.01)
*G10D 3/00* (2006.01)

(52) U.S. Cl.
CPC ..... *G10G 5/00* (2013.01); *G10D 3/00* (2013.01)

(58) Field of Classification Search
CPC ..... G10D 3/00; G10G 5/005; G10G 5/00
See application file for complete search history.

(56) References Cited

U.S. PATENT DOCUMENTS 9,330,645 B2 * 5/2016 Sawhney ..... G10G 5/00

* cited by examiner

*Primary Examiner* — Kimberly Lockett
(74) *Attorney, Agent, or Firm* — Anova Law Group, PLLC

(57) ABSTRACT

The present invention discloses an upright floor stand for guitar, comprising: a support-bar-assembly, a guitar-protecting fork, a fork and a support base, the guitar-protecting fork comprises a guitar-protecting fork body and a plastic back seat rotatably connecting to the guitar-protecting fork body; and mounted on the support-bar-assembly; the support base comprises a load bearing base and three support legs, all the three support legs are hinged to the load bearing base, the support-bar-assembly is mounted on the load bearing base, the fork is engaged with the load bearing base. Through arranging the foldable guitar-protecting fork, the fork and the three support legs, the present invention makes the whole support for guitar a smaller volume after folded, and an easier and more convenient fold, while placing the guitar onto the support, it is more secure and stable, thus it is user-friendly.

11 Claims, 11 Drawing Sheets

UPRIGHT FLOOR STAND FOR GUITAR

CROSS-REFERENCES TO RELATED APPLICATIONS

This application claims the priority to Chinese Patent Application No. 201721216879.9, filed on Sep. 21, 2017, the entire contents of all of which are incorporated herein by reference.

FIELD OF THE INVENTION

The present invention relates to the field of stand, and more particularly, to an upright floor stand for guitar.

BACKGROUND

Most of existing upright floor stand for guitar is made by bending and welding a hollow iron pipe or a solid iron rod, when in carrying, they are usually disassembled into several major parts for packaging. After placing a musical instrument, a guitar-protecting fork arranged on top of the guitar stand usually prevents the musical instrument from falling down or slipping out by using a simple interceptor, shown as FIG. 1, which is a schematic diagram on an existing stand for guitar, having a plurality of following defects:

1. the guitar-protecting fork on top of the guitar stand uses a simple interceptor to prevent the musical instrument from falling down or slipping out, such an operation is dull and inconvenient;
2. two telescopic rods adjust a fixing height relying on loosening or tightening a knob, an operation of using the knob is inconvenient;
3. a load-bearing fork is inconvenient to fold and accommodate, thus occupying space;
4. a whole volume of the stand for guitar in storage is overlarge, thus it is inconvenient to carry out.

Therefore, the current technology needs to be improved and developed.

BRIEF SUMMARY OF THE DISCLOSURE

The technical problem to be solved in the present invention, aiming at the defects of the prior art, provides an upright floor stand for guitar, which is able to be folded easily and convenient for a user to carry.

In order to achieve the above mentioned goals, the technical solution of the present invention to solve the technical problems is as follows:

an upright floor stand for guitar, wherein comprises: a support-bar-assembly, a guitar-protecting fork, a fork and a support base, the guitar-protecting fork comprises a guitar-protecting fork body and a plastic back seat, the plastic back seat is rotatably connecting to the guitar-protecting fork body; and the plastic back seat is mounted on the support-bar-assembly; the support base comprises a load bearing base and three support legs, all the three support legs are hinged to the load bearing base, the support-bar-assembly is mounted on the load bearing base, the fork is engaged with the load-bearing base.

The upright floor stand for guitar, wherein the plastic back seat further has a plurality of plectrum clips arranged, applied to storing a plurality of plectrums.

The upright floor stand for guitar, wherein the guitar-protecting fork body has an accessory accommodating chamber and a plastic cover arranged, the plastic cover is applied to covering the accessory accommodating chamber.

The upright floor stand for guitar, wherein a tail part of the guitar-protecting fork body has a first one-way ratchet tooth arranged, the plastic back seat has a fixed ratchet arranged, a head part of the fixed ratchet has a first plastic plug arranged, the fixed ratchet comprises a second one-way ratchet tooth engaging with the first one-way ratchet tooth and a ratchet shaft formed integrally with the second one-way ratchet tooth, the ratchet shaft has a first pressing spring sheathed, an end of the ratchet shaft connects to a ratchet fixing seat, a head part of the ratchet fixing seat has a second plastic plug arranged.

The upright floor stand for guitar, wherein the guitar-protecting fork body comprises a left arm of guitar-protecting fork and a right arm of guitar-protecting fork, the left arm of guitar-protecting fork comprises a plastic locking arm, a plastic rotation shaft connecting fixedly to the plastic locking arm and a left plastic shell body, the left plastic shell body is composed by a left upper plastic shell and a left lower plastic shell covering and fastening together, the plastic locking arm has a square slot arranged, and the plastic rotation shaft has a torsion spring sheathed, one end of the torsion spring is fixed onto the left lower plastic shell, and another end of the torsion spring connects to the plastic rotation shaft, the right arm of guitar-protecting fork comprises a plastic pressing buckle, applied to engaging the plastic locking arm and a right plastic shell body, the right plastic shell body is composed by a right upper plastic shell and a right lower plastic shell covering and fastening together, the plastic pressing buckle has an upside-down buckle arranged, applied to covering and fastening the square slot, the plastic pressing buckle has a second pressing spring sheathed, the right lower plastic shell has a baffle arranged to squeezing the second pressure spring, and the baffle locates behind the plastic pressing buckle.

The upright floor stand for guitar, wherein the fork comprises a left fork rod, a right fork rod, a fork connecter and a plastic fastener, the bearing seat has a slot arranged, the left fork rod and the right fork rod are hinged with both sides of the fork connecter respectively, and a tail of the fork connecter is hinged with a head of the plastic fastener, a tail of the plastic fastener engages in the slot of the bearing seat.

The upright floor stand for guitar, wherein the support-bar-assembly comprises a first telescopic rod and a second telescopic rod, a diameter of the first telescopic rod is less than that of the second telescopic rod, and the first telescopic rod is nested in the second telescopic rod, between the first telescopic rod and the second telescopic rod, there is a first plastic trigger arranged, the plastic back seat is arranged on the first telescopic rod, and the second telescopic rod is arranged on the load-bearing base.

The upright floor stand for guitar, wherein, a plurality of support-bar holes are arranged on the load-bearing base, the support-bar-assembly further comprises a plastic limiter and a plurality of screws, a diameter of the plastic limiter is larger than that of the second telescopic rod, the plastic limiter is fixed with the second telescopic rod through the plurality of screws, the second telescopic rod passes through the support-bar hole and whose position is limited by the plastic limiter, the load-bearing base further has a second plastic trigger arranged, applied to preventing the second telescopic rod from sliding up and down.

The upright floor stand for guitar, wherein the guitar-protecting fork body further comprises a left protection sleeve and a right protection sleeve, the left protection sleeve and the right protection sleeve are arranged on the left and the right guitar-protecting fork arms respectively.

The upright floor stand for guitar, wherein the three support legs are all antiskid support legs.

Comparing to the prior art, the upright floor stand for guitar provided in the present invention, comprises: a support-bar-assembly, a guitar-protecting fork, a fork and a support base, the guitar-protecting fork comprises a guitar-protecting fork body and a plastic back seat, the plastic back seat is rotatably connecting to the guitar-protecting fork body; and the plastic back seat is mounted on the support-bar-assembly; the support base comprises a load-bearing base and three support legs, all the three support legs are hinged to the load-bearing base, the support-bar-assembly is mounted on the load-bearing base, the fork is engaged with the load-bearing base. Through arranging the foldable guitar-protecting fork, the fork and the three support legs, the present invention makes the whole stand for guitar a smaller volume after folded, and an easier and more convenient fold, while placing the guitar onto the stand, it is more secure and stable, thus it is user-friendly.

DETAILED DESCRIPTION OF EMBODIMENTS

The present invention provides an upright floor stand for guitar, in order to make the purpose, technical solution and the advantages of the present invention clearer and more explicit, further detailed descriptions of the present invention are stated here, referencing to the attached drawings and some preferred embodiments of the present invention. It should be understood that the detailed embodiments of the invention described here are used to explain the present invention only, instead of limiting the present invention.

Figure 1:
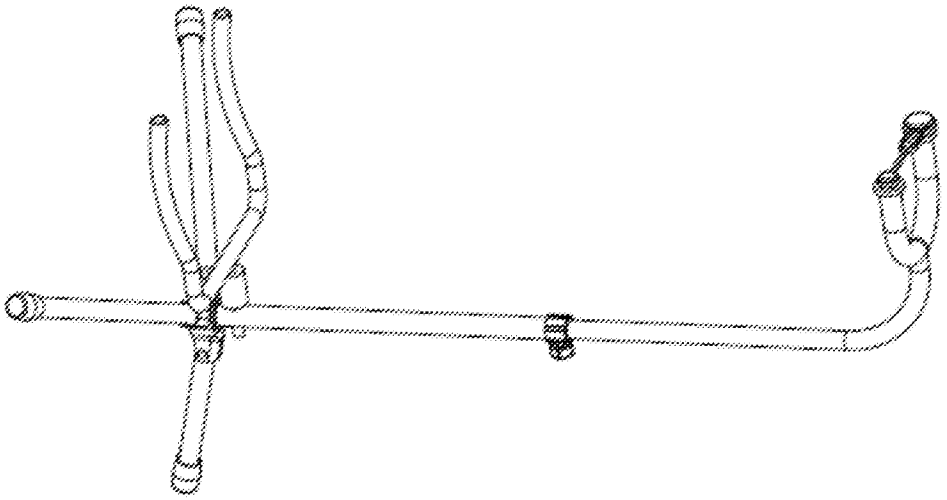
FIG. 1 illustrates a schematic diagram on a floor stand for guitar in the prior art.
Figure 2:
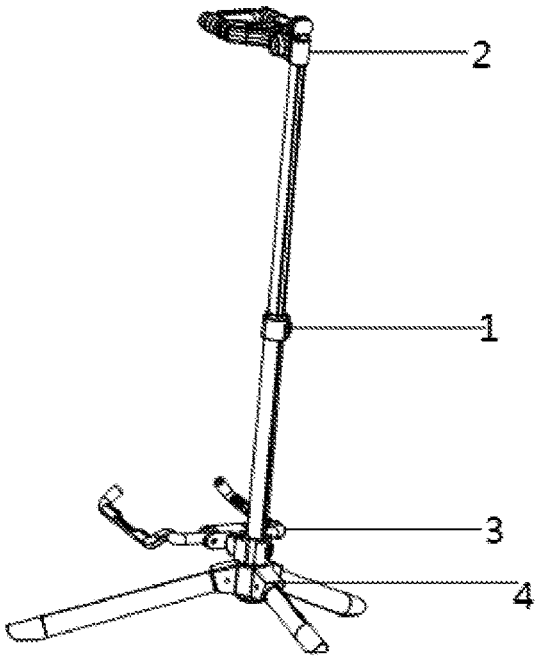
FIG. 2 illustrates a schematic diagram on an upright floor stand for guitar in an opened state provided in the present invention.

Referencing to FIG. 2, the present invention provides an upright floor stand for guitar, comprising: a support-bar-assembly 1, a guitar-protecting fork 2, a fork 3 and a support base 4. Referencing to FIG. 3 together, the guitar-protecting fork 2 comprises a guitar-protecting fork body 21 and a plastic back seat 22, the plastic back seat 22 is rotatably connecting to the guitar-protecting fork body 21, specifically, the plastic back seat 22 connects to the guitar-protecting fork body 21 through a gear meshing mechanism, and the guitar-protecting fork body 21 may rotate according to the plastic back seat 22, making the guitar-protecting fork 2 be able to be opened manually while in working, and be folded while not in working, it is easy for carrying; referencing to FIG. 14 together, the support base 4 comprises a load-bearing base 41 and three support legs 42, all the three support legs 42 are hinged to the load-bearing base 41, while in working, the three support legs 42 are opened to an appropriate angle directly, a fixation of the stand will be achieved, and while not in working, the three support legs 42 are folded, so as to save a space and be easy to carry, also, a folding is easy and simple, further, the support-bar-assembly 1 is mounted on the load-bearing base 41, the fork 3 is engaged with the load-bearing base 41, that makes the fork 3 be able to be disassembled freely, and during carrying, a volume of the stand is smaller after being folded and accommodated, thus a package space is smaller Through arranging the guitar-protecting fork body 21 and the plastic back seat 22 in a rotatable connection, arranging the three support legs 42 and the load-bearing base 41 hinging together, and arranging the fork 3 being disassemble, the present invention makes it easy and simple to fold the stand for guitar, easy to carry, and when placing a guitar onto the stand, it is more secure and more stable.

Figure 3:
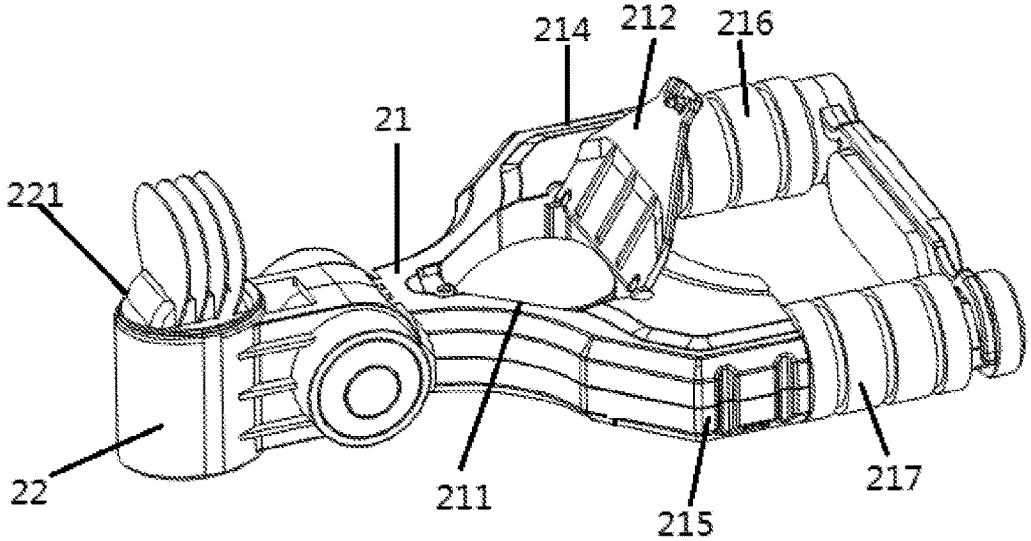
FIG. 3 illustrates a schematic diagram on a guitar-protecting fork in the upright floor stand for guitar provided in the present invention.
Figure 4:
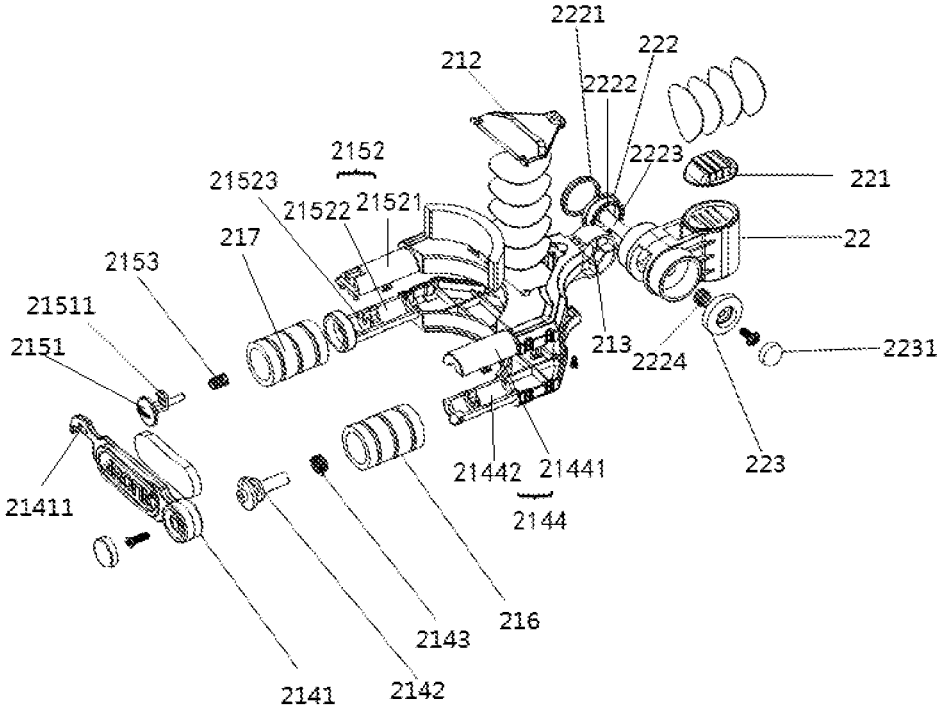
FIG. 4 illustrates a decomposition diagram on the guitar-protecting fork in the upright floor stand for guitar provided in the present invention.
Figure 5:
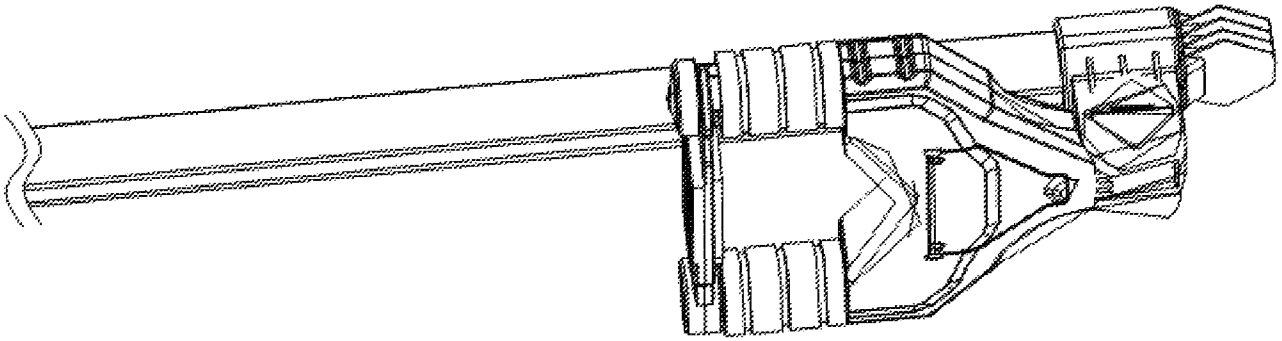
FIG. 5 illustrates a schematic diagram on the guitar-protecting fork in a folded state in the upright floor stand for guitar provided in the present invention.
Figure 6:
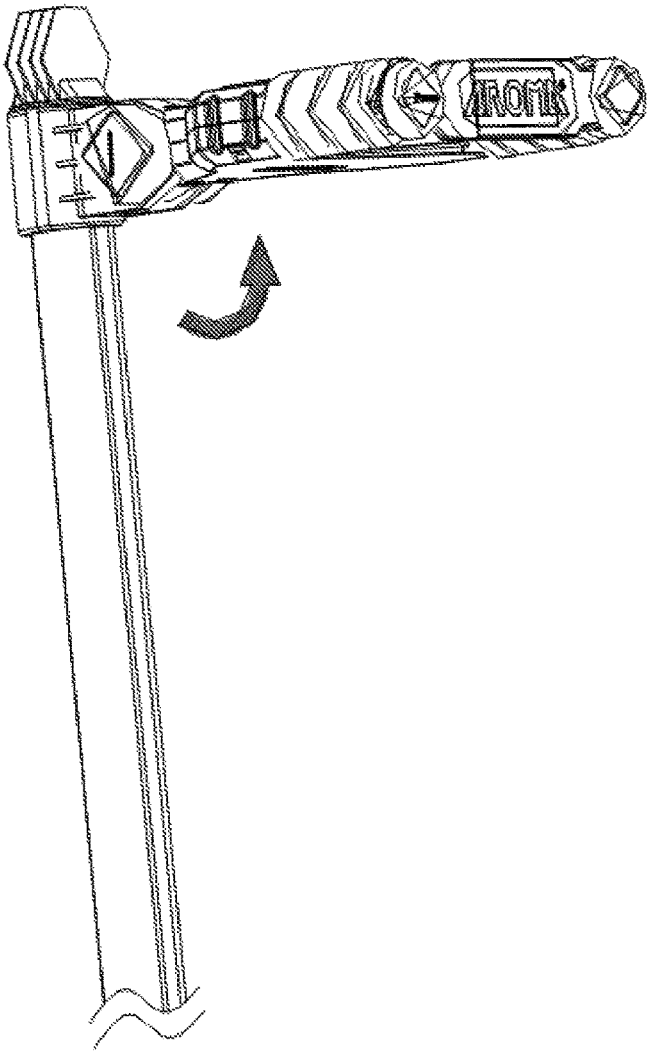
FIG. 6 illustrates a schematic diagram on the guitar-protecting fork in an extended state in the upright floor stand for guitar provided in the present invention.
Figure 7:
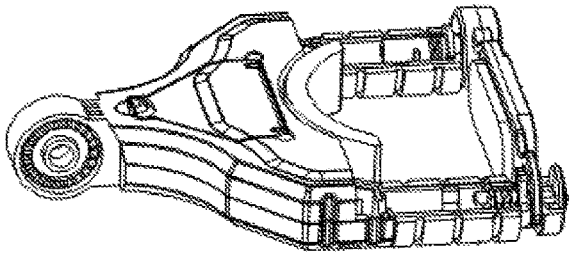
FIG. 7 illustrates a schematic diagram on the guitar-protecting fork in a self-locking state in the upright floor stand for guitar provided in the present invention.
Figure 8:
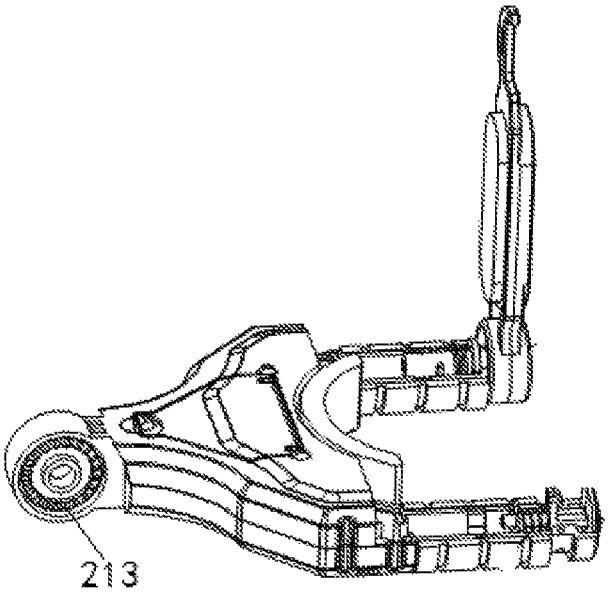
FIG. 8 illustrates a schematic diagram on the guitar-protecting fork in an opened state in the upright floor stand for guitar provided in the present invention.
Figure 9:
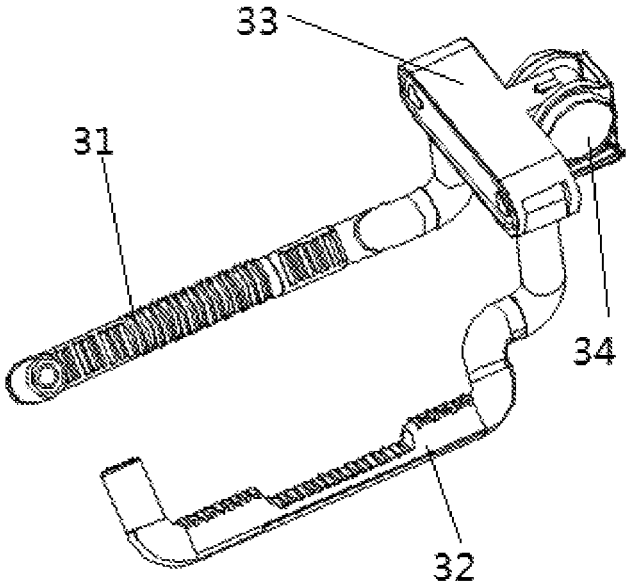
FIG. 9 illustrates a schematic diagram on the fork in the upright floor stand for guitar provided in the present invention.
Figure 10:
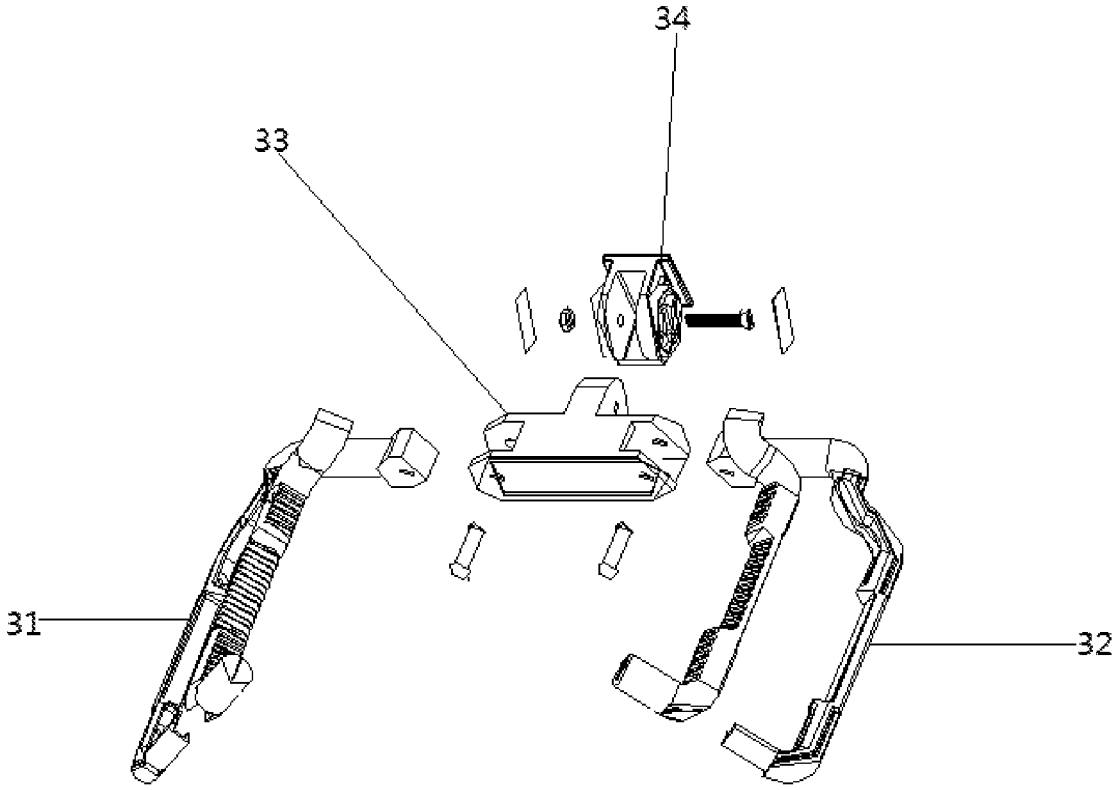
FIG. 10 illustrates a decomposition diagram on the fork in the upright floor stand for guitar provided in the present invention.
Figure 11:
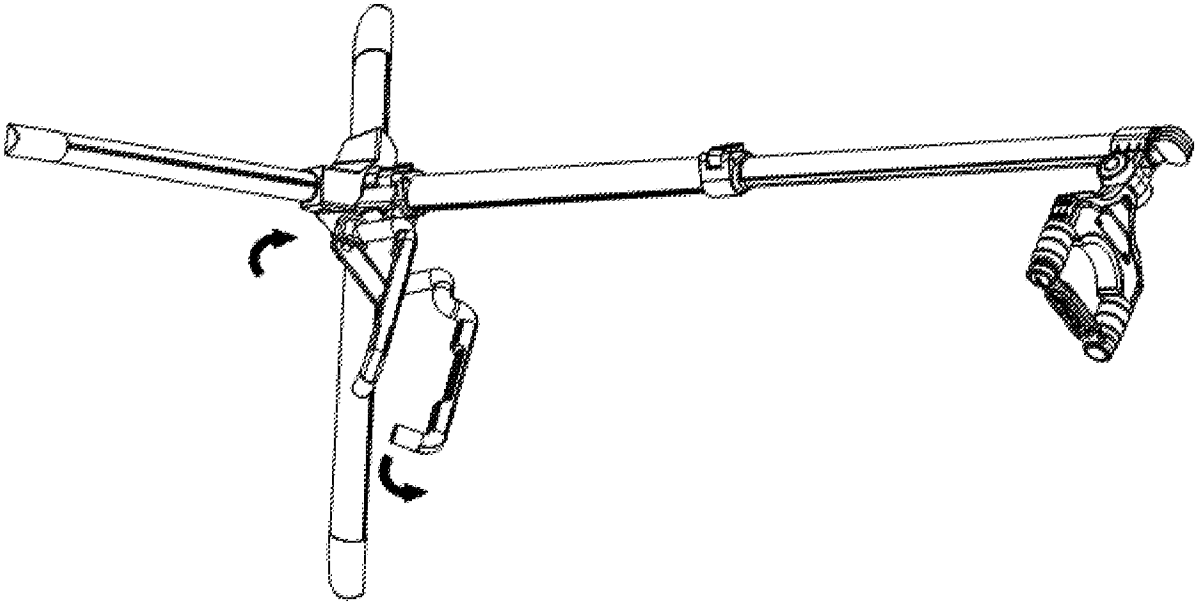
FIG. 11 illustrates a schematic diagram on the fork in a first folding state in the upright floor stand for guitar provided in the present invention.
Figure 12:
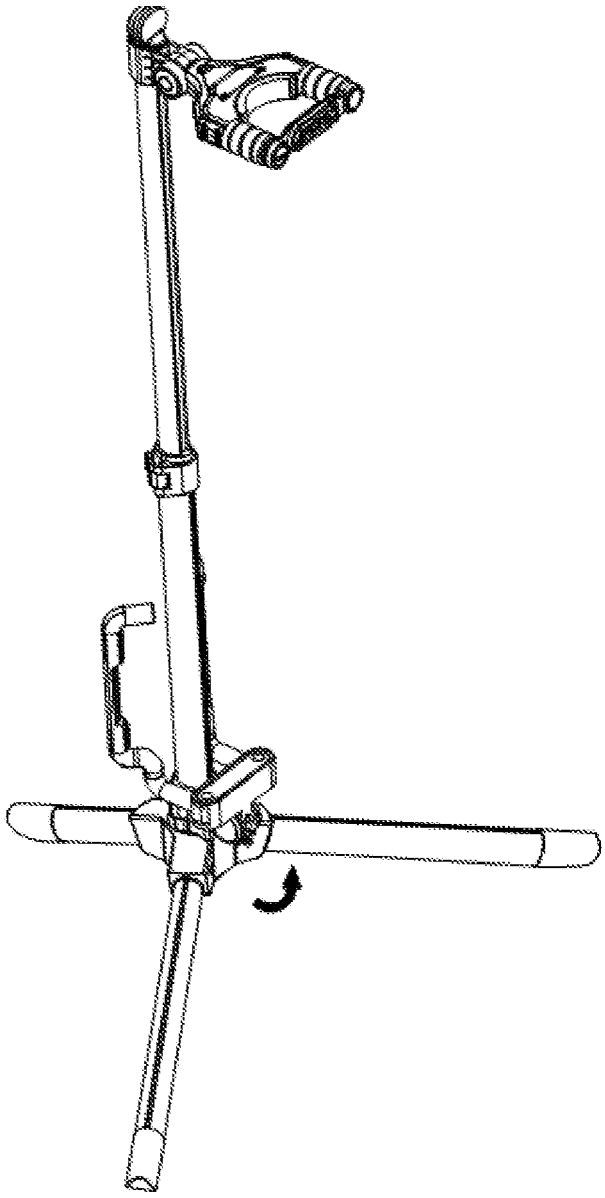
FIG. 12 illustrates a schematic diagram on the fork in a second folding state in the upright floor stand for guitar provided in the present invention.

Referencing to FIG. 3 and FIG. 4, the plastic back seat 22 further has a plurality of plectrum clips 221 arranged, applied to storing a plurality of plectrums, a user may place a plectrum onto the plectrum clip 221, to avoid a loss of the plectrum, and facilitate a user of musician to insert an often used plectrum onto it.

Continue referencing to FIG. 3 and FIG. 4, the guitar-protecting fork body 21 has an accessory accommodating chamber 211 and a plastic cover 212 applied to covering the accessory accommodating chamber 211, the accessory accommodating chamber 211 may be intended for the user of musician to store an accessory not often used, such as a plurality of other plectrums, a plurality of string nails, etc., so as to provide convenience to the user.

Continue referencing to FIG. 3, FIG. 4, FIG. 5, FIG. 6 and FIG. 8, a tail part of the guitar-protecting fork body 21 has a first one-way ratchet tooth 213 arranged, the plastic back seat 22 has a fixed ratchet 222 arranged, a head part of the fixed ratchet 222 has a first plastic plug 2221 arranged, the fixed ratchet 222 comprises a second one-way ratchet tooth 2222 engaging with the first one-way ratchet tooth 213 and a ratchet shaft 2223 formed integrally with the second one-way ratchet tooth 2222, the ratchet shaft 2223 has a first pressing spring 2224 sheathed, an end of the ratchet shaft 2223 connects to a ratchet fixing seat 223, a head part of the ratchet fixing seat 223 has a second plastic plug 2231 arranged.

Specifically, the guitar-protecting fork body 21 achieves a rotation according to the plastic back seat 22 through a one-way ratchet meshing structure, when a working is needed, the guitar-protecting fork body 21 is rotated anti-clockwise through the first one-way ratchet tooth 213, and while it is raised to a certain position, under an action of the first pressing spring 2224, the guitar-protecting fork body 21 is fixed, and being able for the guitar to be placed in, while preventing a musical instrument from dumping and slipping out. When a folding is needed, the first plastic plug 2221 and the second plastic plug 2231 in either side are pinched by a thumb and an index finger, which makes the action of the first pressing spring 2224 disappear, thus makes the guitar-protecting fork body 21 fall back to a perfect folding position, and achieves a folding of the stand for guitar, which is easy and simple.

Continue referencing to FIG. 3, FIG. 4, FIG. 7, and FIG. 8, the guitar-protecting fork body 21 further comprises a left arm of guitar-protecting fork 214 and a right arm of guitar-protecting fork 215, the left arm of guitar-protecting fork 214 comprises a plastic locking arm 2141, a plastic rotation shaft 2142 connecting fixedly to the plastic locking arm 2141 and a left plastic shell body 2144, the left plastic shell body 2144 is composed by a left upper plastic shell 21441 and a left lower plastic shell 21442 covering and fastening together, the plastic locking arm 2141 has a square slot 21411 arranged, and the plastic rotation shaft 2142 has a torsion spring 2143 sheathed, one end of the torsion spring 2143 is fixed onto the left lower plastic shell 21442, another end of the torsion spring 2143 connects to the plastic rotation shaft 2142, the right arm of guitar-protecting fork 215 comprises a plastic pressing buckle 2151, applied to engaging the plastic locking arm 2141 and a right plastic shell body 2152, the right plastic shell body 2152 is composed by a right upper plastic shell 21521 and a right lower plastic shell 21522 covering and fastening together, the plastic pressing buckle 2151 has an upside-down buckle 21511 arranged, applied to covering and fastening the square slot 21411, the plastic pressing buckle 2151 has a second pressing spring 2153 sheathed, the right lower plastic shell 21522 has a baffle 21523 arranged to squeezing the second pressure spring 2153, and the baffle 21523 locates behind the plastic pressing buckle 2151.

Specifically, in an initial (opened) state, the plastic locking arm 2141 is in an opened state under an action of the torsion spring 2143, while the plastic pressing buckle 2151 is always in a pop-out state under an action of the second pressing spring 2153; in a working (self-locking) state, the user pulls the plastic locking arm 2141 down by hand, making the plastic locking arm 2141 contact the plastic pressing buckle 2151, now the plastic pressing buckle 2151 is squeezed back, and the second pressing spring 2153 is further squeezed by the baffle 21523, until the square slot 21411 in the plastic locking arm 2141 engaging onto the upside-down buckle 21511 budged out from the plastic pressing buckle 2151, the second pressure spring 2153 engages the plastic locking arm 2141 under an elastic action, and finishes an action of locking.

On an other hand, when opening the guitar-protecting fork body 21 is needed again, the user directly presses the plastic pressing buckle 2151, to squeeze the second pressure spring 2153, making the plastic pressing buckle 2151 backwards, and release the square slot 21411 in the plastic locking arm 2141, then the plastic locking arm 2141 automatically returns to a specific position by an return action of the torsion spring 2143, that is, an opening of the guitar-protecting fork body 21 is completed Through the ratchet meshing structure, the present invention achieves a folding and extension of the guitar-protecting fork freely, during working, it is needed to rotate the guitar-protecting fork body 21 by hand to achieve an extension of the guitar-protecting fork, and during not working, it is possible to finish folding the guitar-protecting fork by pinching the plastic plugs, also, the present invention achieves an opening and self-locking of the guitar-protecting fork through arranging a plastic arm-locking device, making the guitar more secure and stable when placing onto the stand.

Continue referencing to FIG. 2, FIG. 9, FIG. 10, FIG. 11, FIG. 12 and FIG. 14, the fork 3 comprises a left fork rod 31, a right fork rod 32, a fork connecter 33 and a plastic fastener 34, the bearing seat 41 has a slot 411 arranged, the left fork rod 31 and the right fork rod 32 are hinged with both sides of the fork connecter 33 respectively, and a tail of the fork connecter 33 is hinged with a head of the plastic fastener 34, a tail of the plastic fastener 34 engages in the slot 411 of the bearing seat 41.

Specifically, a part of load-bearing fork of the stand for guitar adopts a second time folding, through hinging the fork rods and the fork connecter 33, it is possible to fold the fork rods, through hinging the fork connecter 33 and the plastic fastener 34, it is possible to fold again the fork connecter 33, and through two times of folding and accommodating, the volume of the stand for guitar is made smaller after folding, and more convenient for carrying, and through engaging the tail part of the plastic fastener 34 into the slot in the bearing seat 41, when a more convenient carrying of the stand for guitar is needed, the fork may be disassembled directly, making the volume of the stand for guitar further smaller after folding, thus it saves more space and is more convenient for carrying.

Figure 13:
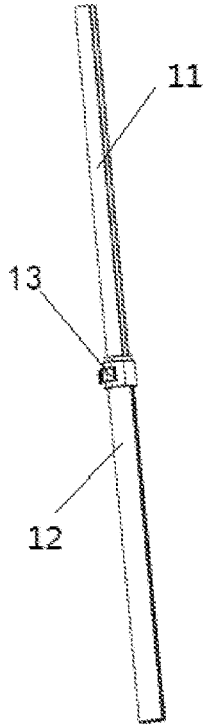
FIG. 13 illustrates a schematic diagram on a support-bar-assembly in the upright floor stand for guitar provided in the present invention.

Continuing referencing to FIG. 2 and FIG. 13, the support-bar-assembly 1 comprises a first telescopic rod 11 and a second telescopic rod 12, a diameter of the first telescopic rod 11 is less than that of the second telescopic rod 12, and the first telescopic rod 11 is nested in the second telescopic rod 12, between the first telescopic rod 11 and the second telescopic rod 12, there is a first plastic trigger 13 arranged, when it is needed to insert the first telescopic rod 11 into the second telescopic rod 12, only the first plastic trigger 13 is needed to release, to achieve an retraction of the support-bar-assembly 1. The plastic back seat 22 is arranged on the first telescopic rod 11, and the second telescopic rod 12 is arranged on the load-bearing base 41. Through using the telescopic rods, a longitudinal length of the stand for guitar is reduced in folding, which further saves the space, and facilitates a height adjustment of the stand for guitar.

Figure 16:
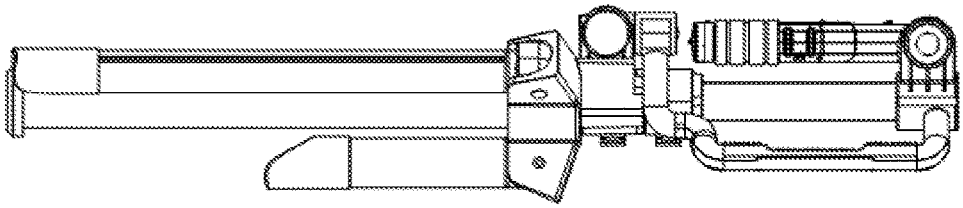
FIG. 16 illustrates a schematic diagram on an upright floor stand for guitar in a folded state provided in the present invention.

Referencing to FIG. 16, after a fully folding, the upright floor stand for guitar provided by the present invention owns a small volume, occupies a small space, and facilitates carrying, provides convenience to the user.

Figure 14:
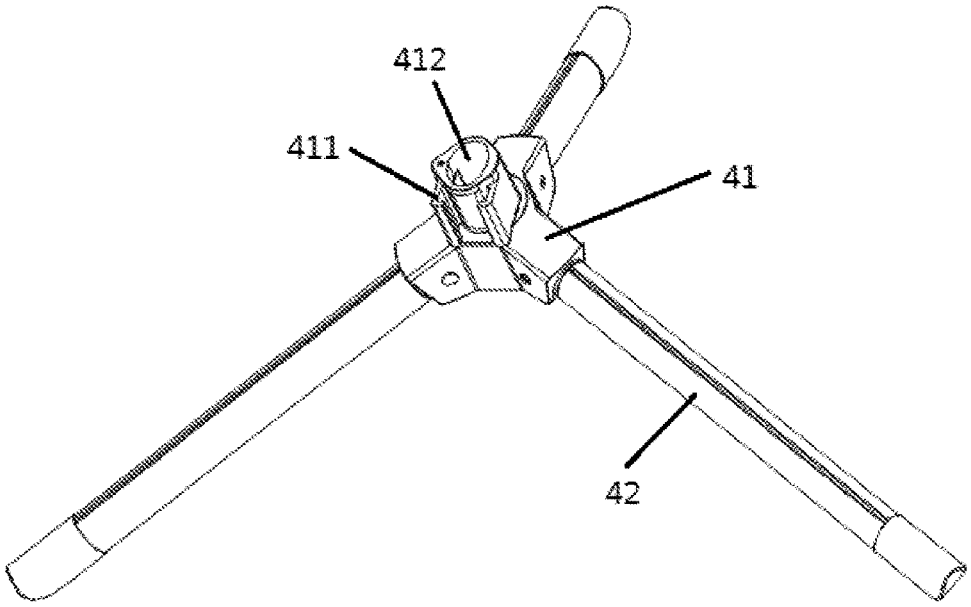
FIG. 14 illustrates a schematic diagram on the support base in the upright floor stand for guitar provided in the present invention.
Figure 15:
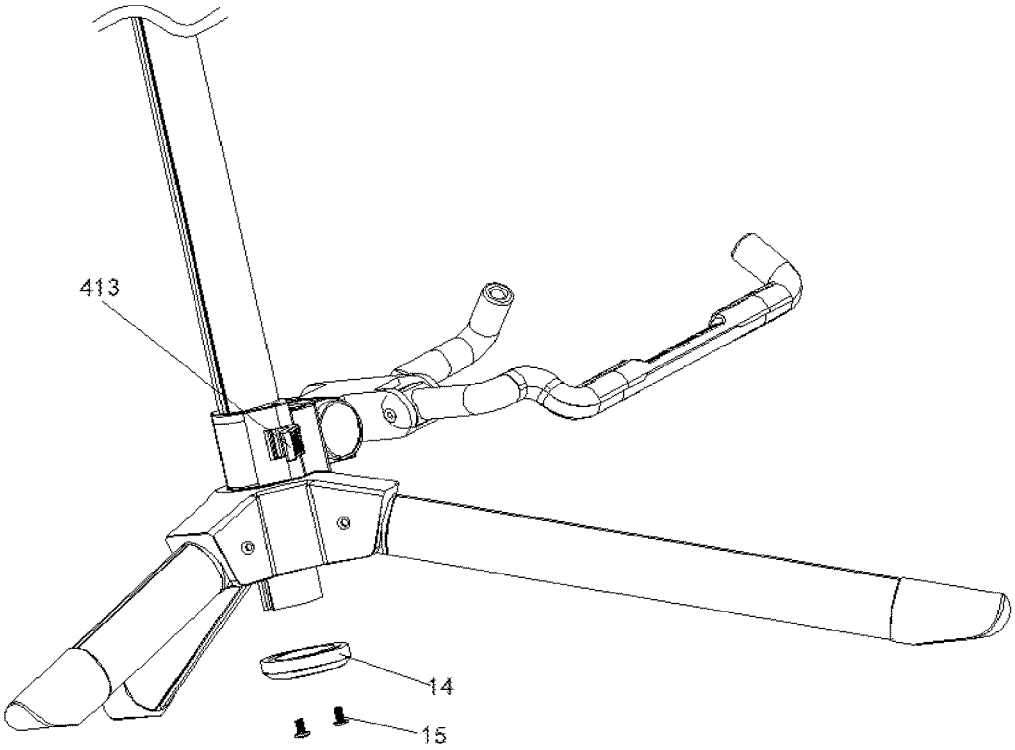
FIG. 15 illustrates a partial schematic diagram on the load-bearing base and the support-bar-assembly in the upright floor stand for guitar provided in the present invention.

Continue referencing to FIG. 14 and FIG. 15, on the load-bearing base 41, there are a plurality of support-bar holes 412, the support-bar-assembly 1 further comprises a plastic limiter 14 and a plurality of screws 15, a diameter of the plastic limiter 14 is larger than that of the second telescopic rod 12, the plastic limiter 14 is fixed with the second telescopic rod 12 through the plurality of screws 15, the second telescopic rod 12 passes through the support-bar hole 412 and whose position is limited by the plastic limiter 14, making the second telescopic rod 12 be able to slide up and down in the support-bar hole 412 only, the load-bearing base 41 further has a second plastic trigger 413 arranged, applied to avoiding the second telescopic rod 12 sliding up and down. If adjusting a height of the stand for guitar is needed, then it is only needed to open the second plastic trigger 413, to make the second telescopic rod 12 slide up and down in the support-bar hole 412, facilitating the user to use. Also, if it is needed to separate the support-bar-assembly 1 and the support base 4, then it is only needed to release the second plastic trigger 413, and remove the plurality of screws 15, before being able to take the support-bar-assembly 1 from the support-bar hole 412, thus a separation of the support-bar-assembly 1 and the support base 4 is achieved, that may further reduce the volume of the stand for guitar in folding, and facilitate carrying.

Continue referencing to FIG. 3, the guitar-protecting fork body 21 further comprises a left protection sleeve 216 and a right protection sleeve 217, the left protection sleeve 216 and the right protection sleeve 217 are arranged on the left guitar-protecting fork arm 214 and the right guitar-protecting fork arm 215 respectively, making a musical instrument not easy to slide after being hung, a soft rubber foam sleeve 108 further protects the musical instrument from getting easily damaged.

Continue referencing to FIG. 14, the three support legs 42 are all antiskid support legs, which increases a friction between the stand for guitar and the ground, ensuring a guitar more secure and stable when being placing on it.

Above all, through arranging the foldable guitar-protecting fork, the fork and the three support legs, the present invention makes the whole stand for guitar a smaller volume after folded, and an easier and more convenient fold, while placing the guitar onto the stand, it is more secure and stable, thus it is user-friendly.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. An upright floor stand for guitar comprising:

a support-bar-assembly;

a guitar-protecting fork attached to a top end of the support-bar-assembly;

a support base attached to a bottom end of the support-bar-assembly; and a fork attached to the support-bar-assembly between the guitar-protecting fork and the support base;

wherein the guitar-protecting fork comprises a guitar-protecting fork body and a plastic back seat, the plastic back seat is rotatably connecting to the guitar-protecting fork body, and the plastic back seat is mounted on the support-bar-assembly;

the support base comprises a load-bearing base and three support legs, all the three support legs are hinged to the load-bearing base, the support-bar-assembly is mounted on the load-bearing base, the fork is engaged with the load-bearing base.

2. An upright floor stand for guitar comprising:

a support-bar-assembly;

a guitar-protecting fork;

a fork; and a support base;

wherein the guitar-protecting fork comprises a guitar-protecting fork body and a plastic back seat, the plastic back seat is rotatably connecting to the guitar-protecting fork body, and the plastic back seat is mounted on the support-bar-assembly;

the support base comprises a load-bearing base and three support legs, all the three support legs are hinged to the load-bearing base, the support-bar-assembly is mounted on the load-bearing base, the fork is engaged with the load-bearing base; and the plastic back seat further has a plurality of plectrum clips applied to storing a plurality of plectrums arranged.

3. The upright floor stand for guitar according to claim 2, wherein the guitar-protecting fork body has an accessory accommodating chamber and a plastic cover arranged, the plastic cover is applied to covering the accessory accommodating chamber.

4. The upright floor stand for guitar according to claim 2, wherein a tail part of the guitar-protecting fork body has a first one-way ratchet tooth arranged, the plastic back seat has a fixed ratchet arranged, a head part of the fixed ratchet has a first plastic plug arranged, the fixed ratchet comprises a second one-way ratchet tooth engaging with the first one-way ratchet tooth and a ratchet shaft formed integrally with the second one-way ratchet tooth, the ratchet shaft has a first pressing spring sheathed, an end of the ratchet shaft connects to a ratchet fixing seat, a head part of the ratchet fixing seat has a second plastic plug arranged.

5. The upright floor stand for guitar according to claim 2, wherein the guitar-protecting fork body comprises a left arm of guitar-protecting fork and a right arm of guitar-protecting fork, the left arm of guitar-protecting fork comprises a plastic locking arm, a plastic rotation shaft connecting fixedly to the plastic locking arm and a left plastic shell body, the left plastic shell body is composed by a left upper plastic shell and a left lower plastic shell covering and fastening together, the plastic locking arm has a square slot arranged, and the plastic rotation shaft has a torsion spring sheathed, one end of the torsion spring is fixed onto the left lower plastic shell, and another end of the torsion spring connects to the plastic rotation shaft, the right arm of guitar-protecting fork comprises a plastic pressing buckle, applied to engaging the plastic locking arm and a right plastic shell body, the right plastic shell body is composed by a right upper plastic shell and a right lower plastic shell covering and fastening together, the plastic pressing buckle has an upside-down buckle arranged, applied to covering and fastening the square slot, the plastic pressing buckle has a second pressing spring sheathed, the right lower plastic shell has a baffle arranged, applied to squeezing the second pressure spring, and the baffle locates behind the plastic pressing buckle.

6. The upright floor stand for guitar according to claim 2, wherein the fork comprises a left fork rod, a right fork rod, a fork connecter and a plastic fastener, the bearing seat has a slot arranged, the left fork rod and the right fork rod are hinged with both sides of the fork connecter respectively, and a tail of the fork connecter is hinged with a head of the plastic fastener, a tail of the plastic fastener engages in the slot of the bearing seat.

7. The upright floor stand for guitar according to claim 2, wherein the support-bar-assembly comprises a first telescopic rod and a second telescopic rod, a diameter of the first telescopic rod is less than that of the second telescopic rod, and the first telescopic rod is nested in the second telescopic rod, between the first telescopic rod and the second telescopic rod, there is a first plastic trigger arranged, the plastic back seat is arranged on the first telescopic rod, and the second telescopic rod is arranged on the load bearing base.

8. The upright floor stand for guitar according to claim 7, wherein a plurality of support-bar holes are arranged on the load bearing base, the support-bar-assembly further comprises a plastic limiter and a plurality of screws, a diameter of the plastic limiter is larger than that of the second telescopic rod, the plastic limiter is fixed with the second telescopic rod through the plurality of screws, the second telescopic rod passes through the support-bar hole and whose position is limited by the plastic limiter, the load bearing base further has a second plastic trigger arranged, applied to preventing the second telescopic rod from sliding up and down.

9. The upright floor stand for guitar according to claim 5, wherein the guitar-protecting fork body further comprises a left protection sleeve and a right protection sleeve, the left protection sleeve and the right protection sleeve are arranged on the left and the right guitar-protecting fork arms respectively.

10. The upright floor stand for guitar according to claim 2, wherein the three support legs are all antiskid support legs.

11. The upright floor stand for guitar according to claim 1, wherein the fork comprises two fork rods, and each of the two fork rods is foldable through a hinge.

* * * * *